US008031167B2

(12) United States Patent
Lee et al.

(10) Patent No.: US 8,031,167 B2
(45) Date of Patent: Oct. 4, 2011

(54) METHOD AND APPARATUS FOR CONTROLLING BACKLIGHT IN DISPLAY DEVICE

(75) Inventors: Dong-Yul Lee, Yongin-si (KR); Jong Seon Kim, Seongnam-si (KR); Jae Suk Yu, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 970 days.

(21) Appl. No.: 11/951,648

(22) Filed: Dec. 6, 2007

(65) Prior Publication Data

US 2008/0186294 A1 Aug. 7, 2008

(30) Foreign Application Priority Data

Feb. 1, 2007 (KR) ..... 10-2007-0010459

(51) Int. Cl.
*G09G 3/36* (2006.01)
*G09G 5/10* (2006.01)

(52) U.S. Cl. ..... 345/102; 345/690

(58) Field of Classification Search ..... 345/102, 345/207, 87–89, 690

See application file for complete search history.

(56) References Cited

U.S. PATENT DOCUMENTS

| | | | | |
|---|---|---|---|---|
| 7,202,458 | B2 * | 4/2007 | Park | 250/205 |
| 7,309,851 | B2 * | 12/2007 | Huang et al. | 250/205 |
| 7,358,988 | B1 * | 4/2008 | Konishi et al. | 348/222.1 |
| 7,564,438 | B2 * | 7/2009 | Kao et al. | 345/89 |
| 2005/0057484 | A1 * | 3/2005 | Diefenbaugh et al. | 345/102 |
| 2006/0274026 | A1 * | 12/2006 | Kerofsky | 345/102 |
| 2007/0097065 | A1 * | 5/2007 | Kreek et al. | 345/102 |
| 2007/0171217 | A1 * | 7/2007 | Tsai et al. | 345/207 |

FOREIGN PATENT DOCUMENTS

| | | |
|---|---|---|
| JP | 2003-348497 | 12/2003 |
| KR | 94-15587 | 7/1994 |
| KR | 1020010010195 | 2/2001 |
| KR | 10-2006-0080217 | 7/2006 |

OTHER PUBLICATIONS

English Abstract for Publication No. 94-15587, Jul. 21, 1994.
English Abstract for Publication No. 1020010010195, Feb. 5, 2001.
English Abstract for Publication No. 2003-348497, Dec. 5, 2003.
English Abstract for Publication No. 10-2006-0080217, Jul. 7, 2006.

* cited by examiner

*Primary Examiner* — Amare Mengistu
*Assistant Examiner* — Hong Zhou
(74) *Attorney, Agent, or Firm* — F. Chau & Associates, LLC

(57) ABSTRACT

A method and circuit for controlling the brightness of a backlight in a display device. The circuit comprises a backlight brightness selecting block that measures the brightness of ambient light and selects brightness information of the backlight based on the measured brightness of the ambient light. An image processing block performs image processing on received image signal based on the measured brightness of the ambient light, and calculates an image processing gain of the received image signal based on the result of image processing and the received image signal. A backlight adjusting unit controls the brightness of the backlight based on the selected backlight brightness information and the image processing gain.

16 Claims, 5 Drawing Sheets

METHOD AND APPARATUS FOR CONTROLLING BACKLIGHT IN DISPLAY DEVICE

CROSS-REFERENCE TO RELATED PATENT APPLICATION

This application claims priority to Korean Patent Application No. 10-2007-0010459, filed on Feb. 1, 2007, in the Korean Intellectual Property Office, the disclosure of which is hereby incorporated by reference.

BACKGROUND OF THE INVENTION

1. Technical Field

The present invention relates to a display device, and more particularly, to a method and apparatus for controlling a backlight in a display device.

2. Discussion of the Related Art

Apparatuses having display devices can be used in environments having various levels of illumination. For example, they can be used in a high-illumination ambient environment, such as an office using fluorescent lamps, a general illumination environment, in which sunlight is used as main light, and in a low-illumination ambient environment, such as a theater.

A backlight is available for a user to more conveniently use an apparatus having a display device under various environments. For example, a Light Emitted Diode (LED) may be mounted as the backlight on a keypad or a display unit of a mobile communication terminal, such as a mobile phone, so that a user can conveniently use the terminal in a dark place.

Power consumption required to operate a backlight in a display panel, e.g., a Liquid Crystal Display (LCD) panel, is about 70% of the total power consumption of the LCD panel.

Power consumption may be reduced by actively controlling the intensity of a backlight according to the brightness of ambient light and power consumption may be reduced by applying a brightness enhancement algorithm to an input image.

However, when the backlight is simply controlled according to the brightness of ambient light, the rate of power consumption varies depending on the brightness of the ambient light. Accordingly, power consumption may still be high under a high-illumination environment, such as an office or the outdoors.

When applying the brightness enhancement algorithm to an input image, power consumption can be reduced irrespective of an ambient illumination environment. However, since power consumption is not controlled adaptively to the ambient illumination environment, an image looks too bright when the environment is dark and looks too dark when the ambient environment is bright.

SUMMARY OF THE INVENTION

An exemplary embodiment of the present invention provides a method and circuit for controlling the brightness of a backlight in a display panel by using an algorithm appropriate for improving the brightness of an input image in consideration of an ambient illumination environment.

According to an aspect of the present invention, there is provided a circuit for controlling a backlight. The circuit includes a backlight brightness selecting block, an image processing block, and a backlight adjusting unit.

The backlight brightness selecting block measures the brightness of ambient light, and selects brightness information of the backlight based on the measured brightness of the ambient light.

The image processing block performs image processing on a received image signal based on the measured brightness of the ambient light, and calculates an image processing gain of the received image signal based on the result of image processing and the received image signal.

The backlight adjusting unit controls the brightness of the backlight based on the selected backlight brightness information and the image processing gain.

According to an aspect of the present invention, there is provided a display device including the backlight brightness selecting block, the image processing block, the backlight adjusting unit, and a display panel being driven based on the result of image processing.

According to an aspect of the present invention, there is provided a method of controlling the brightness of a backlight in a display device. The method includes selecting brightness of the backlight, calculating an image processing gain of received image signal, and controlling the brightness of the backlight.

The selecting of brightness of the backlight includes measuring the brightness of ambient light, and selecting brightness information of the backlight based on the measured brightness of the ambient light.

The calculating of an image processing gain includes performing image processing on the received image signal based on the measured brightness of the ambient light, and calculating an image processing gain of the received image signal based on the result of image processing and the received image signal. The controlling of the brightness of the backlight includes controlling the brightness of the backlight in a display device based on the selected backlight brightness information and the image processing gain.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION OF EXEMPLARY EMBODIMENTS

Figure 1:
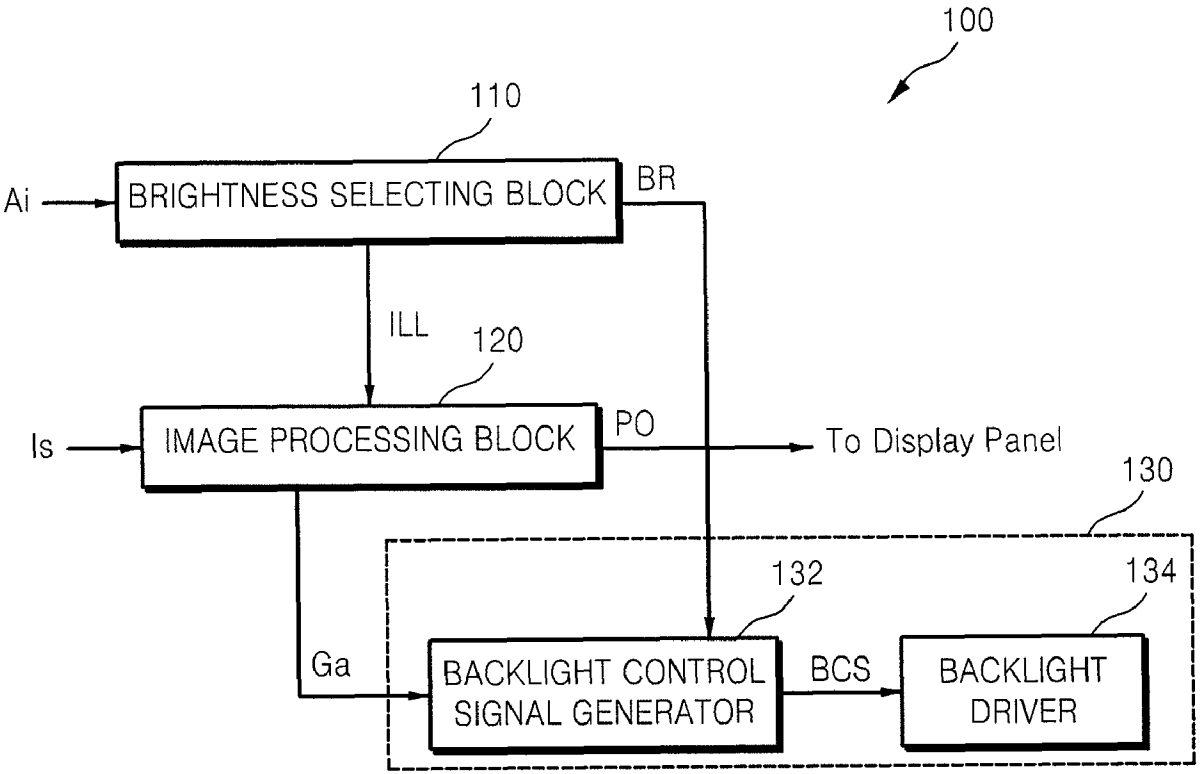
FIG. 1 is a block diagram of a circuit for controlling a backlight, according to an exemplary embodiment of the present invention.

Exemplary embodiments of the present invention will now be described more fully hereinafter with reference to the accompanying drawings. This invention may, however, be embodied in many different forms and should not be construed as limited to the exemplary embodiments set forth herein. Rather, these exemplary embodiments are provided so that this disclosure will be thorough and complete, and will fully convey the scope of the invention to those skilled in the art. In the drawings, the size and relative sizes of layers and regions may be exaggerated for clarity. Like numbers may refer to like elements throughout.

FIG. 1 is a block diagram of a circuit 100 that controls a backlight according to an exemplary embodiment of the present invention. Referring to FIG. 1, the circuit 100 includes a brightness selecting block 110, an image processing block 120, and a backlight adjusting unit 130.

The brightness selecting block 110 measures the brightness ILL of ambient light Ai, for example, the outside illumination, and selects backlight brightness information BR based on the measured brightness ILL of the ambient light Ai.

The image processing block 120 performs image processing on received image signal Is based on the measured brightness ILL of the ambient light, and calculates an image processing gain Ga of the received image signal Is based on the result of image processing PO and the received image signal Is.

The backlight adjusting unit 130 controls the brightness of a backlight (not shown) in a display panel based on the selected backlight brightness information BR and the image processing gain Ga.

The backlight adjusting unit 130 includes a backlight control signal generator 132, and a backlight driver 134.

The backlight control signal generator 132 generates a backlight control signal BCS based on the selected backlight brightness information BR and the image processing gain Ga. The backlight driver 134 drives the backlight in a display panel based on the backlight control signal BCS.

The backlight driver 134 drives the backlight, e.g., a Light Emitted Diode (LED), based on the backlight control signal BCS.

Figure 2:
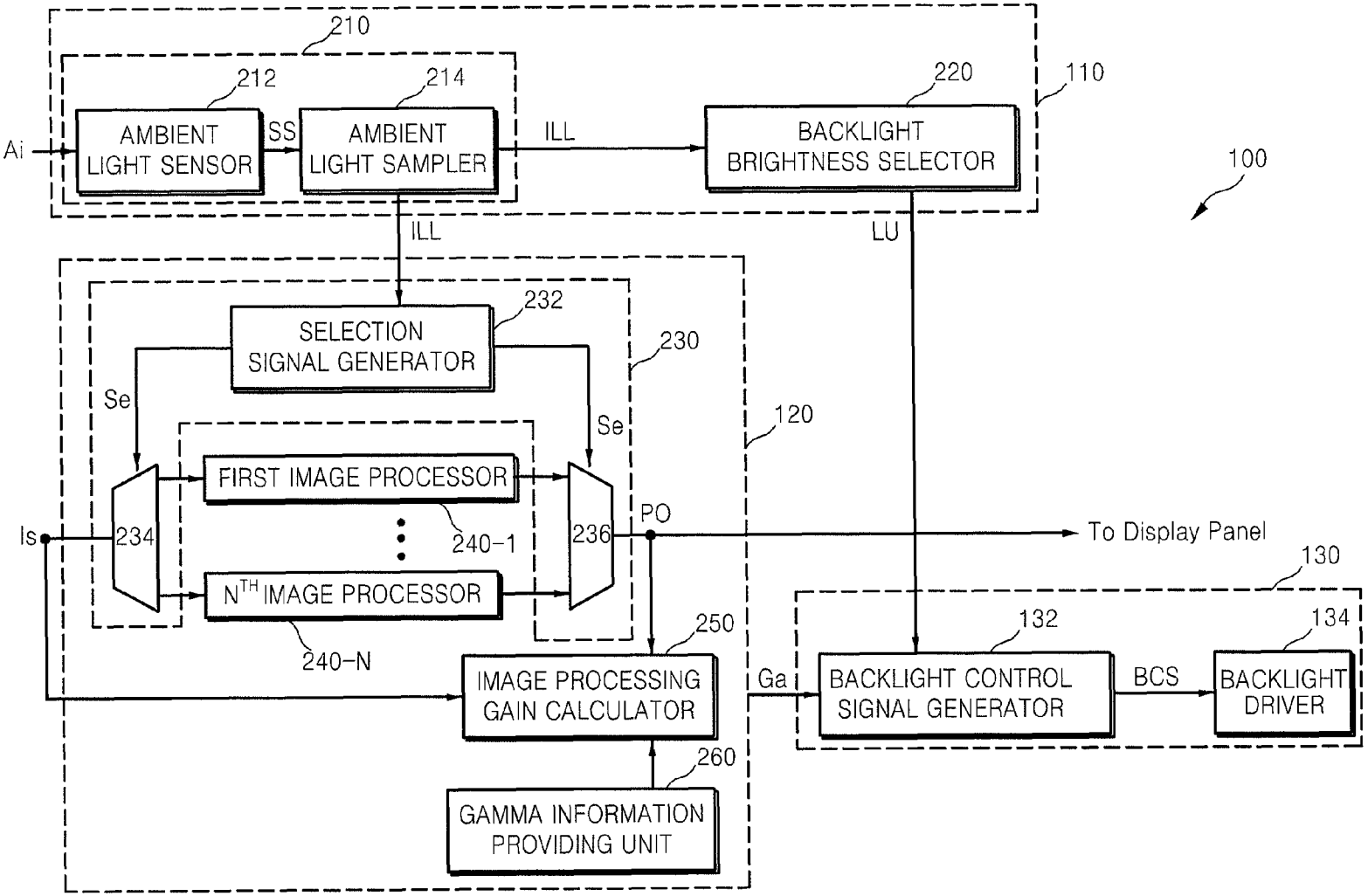
FIG. 2 is a detail block diagram illustrating the circuit of FIG. 1.

FIG. 2 is a block diagram illustrating in detail the circuit 100 of FIG. 1. Referring to FIG. 2, the backlight brightness selecting block 110 includes an ambient light measuring unit 210 and a backlight brightness selector 220.

The ambient light measuring unit 210 senses ambient light, and measures the brightness of the ambient light based on the sensing result. The ambient light measuring unit 210 includes an ambient light sensor 212 and an ambient light sampler 214.

The ambient light sensor 212 senses the ambient light and outputs a sensed signal SS based on the sensing result. The ambient light sensor 212 may be embodied as a photo diode. The ambient light sampler 214 performs sampling on the sensed signal SS, and outputs a sampled signal ILL. The level of the sampled signal ILL represents the brightness level of the ambient light.

The backlight brightness selector 220 selects brightness information BR corresponding to the brightness level ILL of the ambient light, for example, the intensity of the sampled signal ILL.

Although not shown, the backlight brightness selector 220 may include a lookup table and a brightness selector.

The lookup table may store a plurality of pieces of predetermined backlight brightness information that respectively correspond to a plurality of brightness levels of the ambient light. The brightness selector is capable of selecting backlight bright information BR from among the plurality of the pieces of the backlight brightness information stored in the lookup table based on the sampled signal ILL, and outputting the selected backlight bright information BR.

The image processing block 120 includes an image processing selector 230, a plurality of image processors 240-1 through 240-N, an image processing gain calculator 250, and a gamma information providing unit 260 (wherein N is a natural number).

The image processing selector 230 selects one of the image processors 240-1 through 240-N based on the measured brightness ILL of the ambient light, for example, the sampled signal ILL, and enables the selected image processor.

The image processing selector 230 may include a selection signal generator 232, a multiplexer 234, and a demultiplexer 236.

The selection signal generator 232 generates a selection signal Se based on the measured brightness ILL of the ambient light, for example, the sampled signal ILL.

The multiplexer 234 is capable of receiving an image signal Is and outputting it to one of the image processors 240-1 through 240-N, in response to the selection signal Se.

The demultiplexer 236 is capable of selecting an output of the image processor selected from among the image processors 240-1 through 240-N by the multiplexer 234, in response to the selection signal Se.

Each of the image processors 240-1 through 240-N performs image processing on the received image signal Is using a predetermined image enhancement algorithm, and simultaneously outputs the result of image processing to both a display panel (not shown) and the image processing gain calculator 250.

Thus, the image processing selector 230 selects a most effective image enhancement algorithm according to the measured brightness ILL of the ambient light, or transmits information regarding the measured brightness ILL of the ambient light as a parameter of the predetermined algorithm if necessary.

Also, the image processing selector 230 may select and enable only one of the image processors 240-1 through 240-N in order to reduce power consumption.

For example, an image enhancement algorithm capable of improving the visibility of an image by increasing the extent of image enhancement even if the image is slightly degraded, may be used in a high illumination environment.

However, an image enhancement algorithm capable of reducing image degradation even if the extent of image enhancement is low, may be used in a low illumination environment.

The image processing gain calculator 250 calculates and outputs an image processing gain Ga of the received image signal Is, based on the received image signal Is and the result of image processing PO. The image processing gain Ga signifies the extent to which the brightness of the image is enhanced.

The image processing gain Ga may be calculated using various ways, and one of the various ways will now be described using an example.

First, the image processing gain Ga can be calculated based on an average gain of a display panel that consists of N pixels, using the following Equations (1) and (2) (Here, N is a natural number):

$$PGain(\%)=(Pixelout(\%)-Pixelin(\%))/Pixelout(\%)\times 100 \quad (1),$$

wherein Pixelin(%) denotes the level of image signal Is of one pixel of the display panel, Pixelout(%) denotes the level of the image signal Is that has been image processed, and PGain(%) denotes an image processing gain of the pixel of the display panel. Each of Pixelin(%), Pixelout(%), and PGain(%) can be expressed as a percentage.

$$AVGain = \sum_{x=1}^{N} \frac{PGainx}{N}, \quad (2)$$

wherein AVGain denotes an average gain of the display panel that consists of N pixels.

Thus, the average gain AVGain calculated by Equations (1) and (2) may be equal to the image processing gain Ga (Ga=AVGain).

Next, the image processing gain Ga may be calculated by subtracting a weight from the average gain AVGain, for example, Ga=AVGain−Weight.

For example, the weight may be calculated as follows.

First, the image processing gain PGain(%) corresponding to each pixel of the display panel is calculated by Equation (1), and the average gain AVGain of the display panel is calculated by Equation (2).

A histogram is obtained in which the image processing gain PGain(%) of the pixels of the display panel is split into intervals of a predetermined size, e.g., 0 to 5%, 6 to 10%, and so on.

In the histogram, the weight may be determined by the frequency of the image processing gains PGain(%) less the average gain AVGain.

Figure 3:
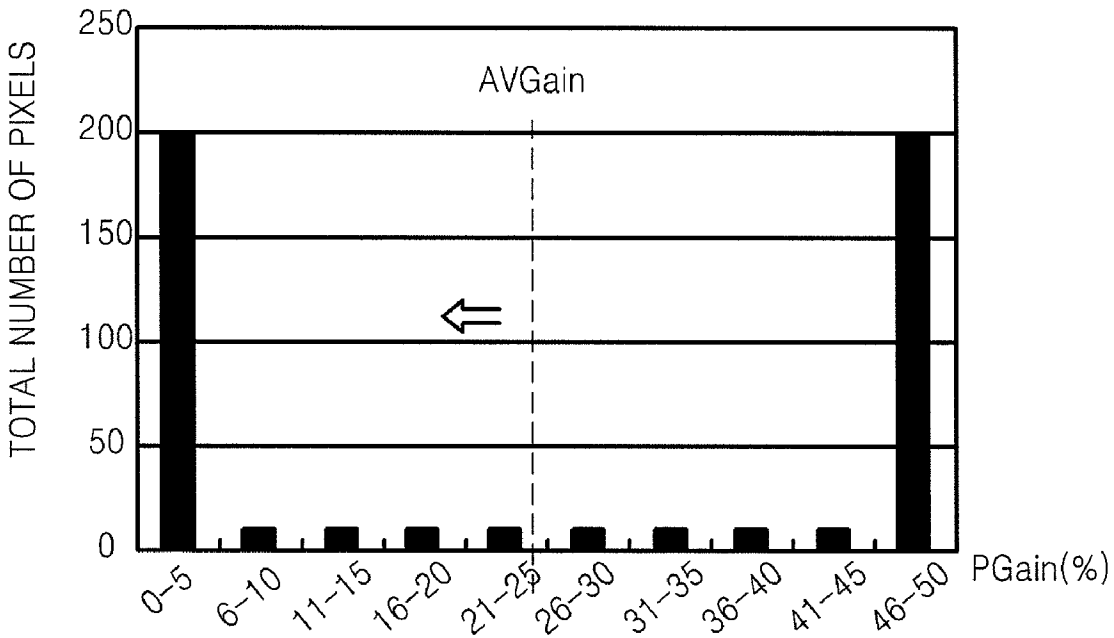
FIG. 3 is a histogram illustrating a gain corresponding to each pixel of a display panel and an average gain of the display panel, according to an exemplary embodiment of the present invention.

FIG. 3 is a histogram illustrating an image processing gain PGain(%) of pixels of a display panel and an average gain AVGain of the display panel, which are calculated by Equations (1) and (2), according to an exemplary embodiment of the present invention. Referring to FIG. 2, the weight may be calculated based on the histogram, using the following Equation (3):

$$\text{Weight} = \sum_{d=0} = f(d) \times Fre(d), \quad (3)$$

wherein d denotes the distance between the interval to which the average gain AVGain belongs, and an interval that is to be calculated. In FIG. 2, the distance d may be 0, 1, 2, 3, or 4.

For example, if the interval to which the average gain AVGain belongs ranges from 21 to 25% and if d=4, then the interval that is to be calculated ranges from 0 to 5%.

In Equation (3), f(d) may be a constant function, a primary function, or a secondary function that is experimentally obtained.

For example, the weight and the distance d may be functions, such as primary functions, which are proportional to each other. In Equation (3), Fre(d) denotes the frequency of the interval, e.g., the interval ranging from 0 to 5%, which is to be calculated. Next, an image processing system using gamma may calculate the image processing gain Ga in consideration of image processing using gamma correction.

The gamma information providing unit 260 provides the image processing gain calculator 250 with information regarding a gamma curve of the image processing system.

The image processing system transforms the result of image processing PO using the gamma curve, and outputs the transformed result to the display panel. Thus, the image processing system calculates the image processing gain based on the gamma curve.

The backlight control signal generator 132 generates a backlight control signal BCS based on the selected backlight brightness information BR and the image processing gain Ga.

For example, backlight brightness BL may be calculated using the following Equation (4):

$$BL(\%) = BR(\%) - (BR(\%) \times Ga(\%))/100 \quad (4),$$

wherein BL(%) and BR(%) respectively denote the backlight brightness BL and the selected backlight brightness information BR that are expressed as a percentage, and Ga(%) denotes the image processing gain Ga expressed as a percentage.

Thus, the backlight control signal generator 132 generates the backlight control signal BCS based on the backlight brightness BL. The backlight driver 134 may drive a backlight (not shown), for example a Light Emitted Diode (LED), based on the backlight control signal BCS.

Figure 4:
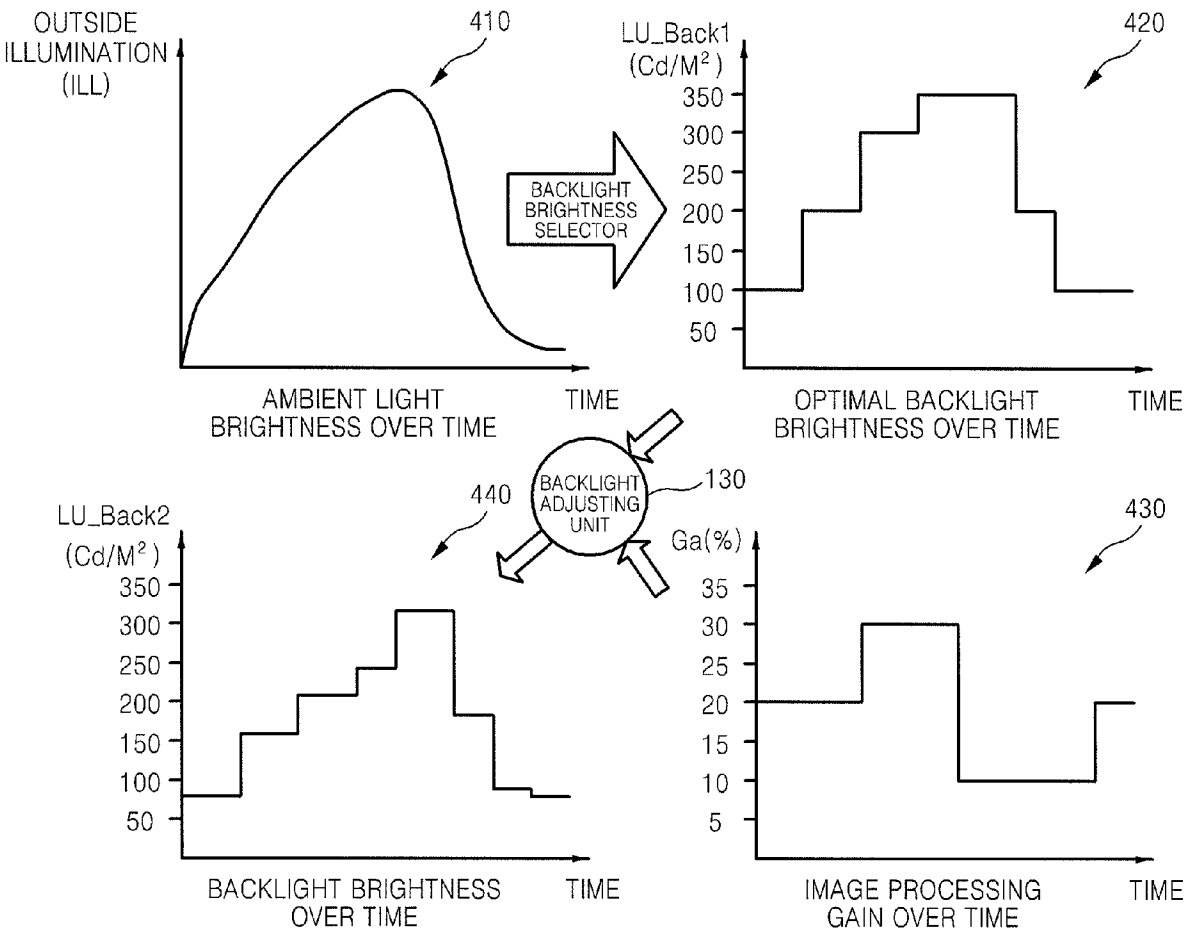
FIG. 4 is a set of graphs illustrating a variation in the brightness of a backlight according to an exemplary embodiment of the present invention, the brightness being determined by a combination of a brightness selecting block and an image processing block illustrated in FIG. 1.

FIG. 4 includes four graphs, 410, 420, 430 and 440, illustrating a variation in the brightness of a backlight, according to an exemplary embodiment of the present invention, the brightness being determined by a combination of the brightness selecting block 110 and the image processing block 120 illustrated in FIG. 1. Referring to FIG. 4, the first graph 410 illustrates a variation in the brightness of ambient light versus time, particularly, a variation in outside illumination. The outside illumination may be measured by the ambient light measuring unit 210 of FIG. 2.

The second graph 420 illustrates a variation in the brightness of the backlight versus the outside illumination illustrated in the first graph 410. For example, the backlight brightness selector 220 is capable of selecting brightness BR of the backlight appropriate for the outside illumination ILL measured by the ambient light measuring unit 210. The second graph 420 illustrates first backlight illumination LU_Back1 corresponding to the selected brightness BR of the backlight.

The third graph 430 illustrates a variation in an image processing gain Ga of an input image processed by the image processing block 120 of FIG. 1 versus time, which is expressed as a percentage (%).

The fourth graph 440 illustrates second backlight illumination LU_Back2 determined based on the brightness BR of the backlight corresponding to the first backlight illumination LU_Back1 and the image processing gain Ga.

Thus, the fourth graph 440 illustrates the second backlight illumination LU_Back2 determined in consideration of all the brightness ILL of the ambient light and the image processing gain Ga of the input image signal Is.

The illumination of the backlight over time illustrated in the second backlight illumination LU_Back2 in the fourth graph 440 is partially lower than in the first backlight illumination LU_Back1 in the second graph 420. Accordingly, it is possible to prevent unnecessary power consumption while improving the visibility of the image.

Figure 5:
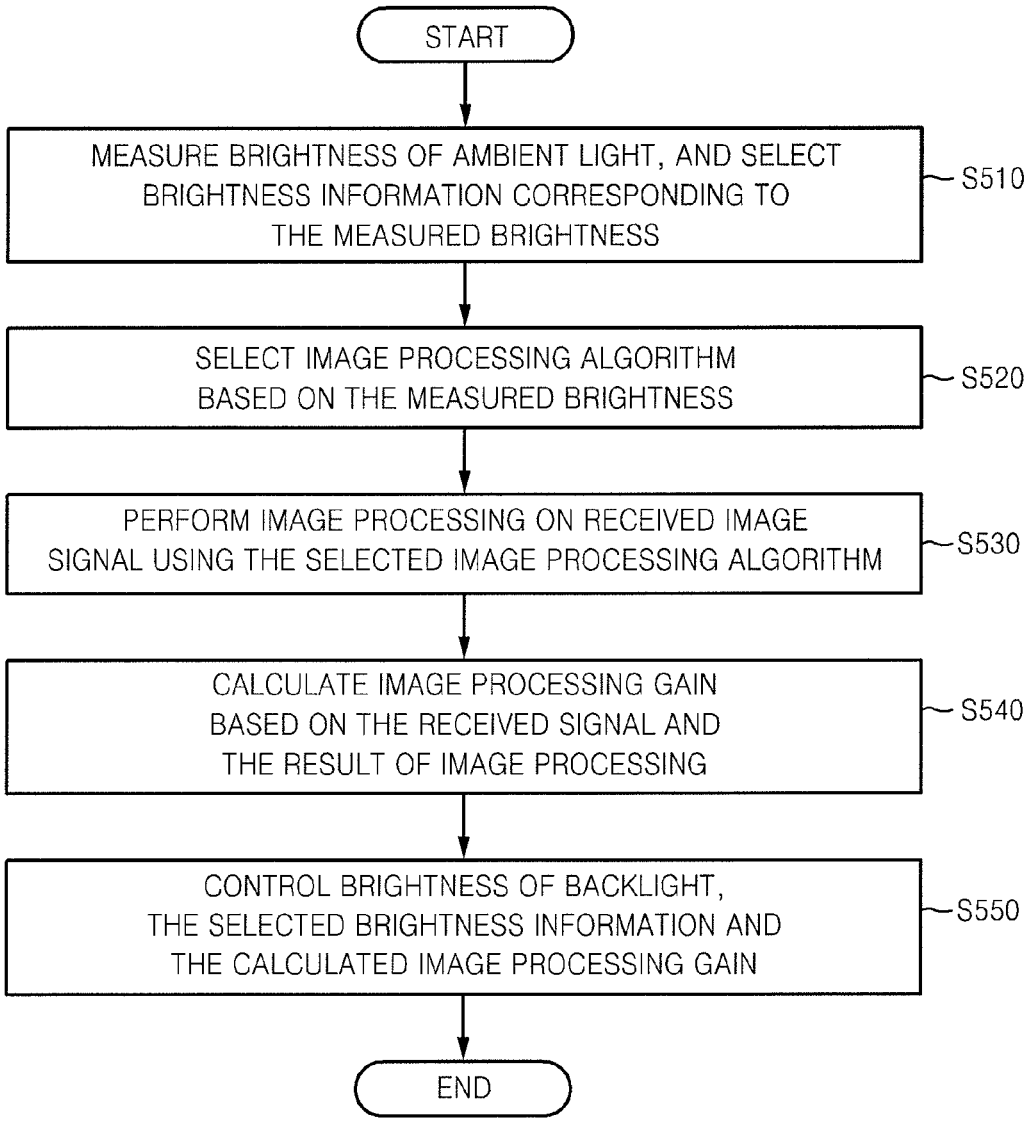
FIG. 5 is a flowchart illustrating a method of controlling the brightness of a backlight in a display device, according to an exemplary embodiment of the present invention.

FIG. 5 is a flowchart illustrating a method of controlling the brightness of a backlight in a display device, according to an exemplary embodiment of the present invention. Referring to FIGS. 2 and 5, the brightness selecting block 110 measures the brightness ILL of ambient light, and selects brightness information BR of a backlight based on the measured brightness ILL of the ambient light (operation S510).

For example, the image processing block 120 outputs an image processing selection signal based on the measured brightness ILL of the ambient light, and selects one of a plurality of image processing algorithms based on the image processing selection signal (operation S520).

The image processing block 120 performs image processing on a received image signal using the selected image processing algorithm, and outputs the result of image processing (operation S530).

The image processing block 120 calculates an image processing gain Ga of the received image signal, based on the received image signal and the result of image processing (operation S540). For example, the image processing gain Ga may be calculated using Equations (1) through (4).

The backlight adjusting unit 130 controls the brightness of the backlight, based on the selected brightness information BR and the calculated image processing gain Ga (operation S550). For example, the backlight adjusting unit 130 may generate a backlight control signal BCS based on the selected brightness information BR and the image processing gain Ga, and drive the backlight driver 134 based on the backlight control signal BCS.

As described above, in a method and apparatus for controlling the brightness of a backlight in a display device, according to exemplary embodiments of the present invention, the brightness of a backlight is controlled using an appropriate image processing algorithm according to the brightness of ambient light, thereby improving the visibility of an image and prevent unnecessary power consumption.

While the present invention has been particularly shown and described with reference to exemplary embodiments thereof, it will be understood by those of ordinary skill in the art that various changes in form and details may be made therein without departing from the spirit and scope of the present invention.

What is claimed is:

1. A circuit for controlling a backlight, the circuit comprising:

a backlight brightness selecting block measuring the brightness of ambient light, and selecting brightness information of the backlight based on the measured brightness of the ambient light;

an image processing block performing image processing on a received image signal based on the measured brightness of the ambient light, and calculating an image processing gain of the received image signal based on the result of image processing and the received image signal; and a backlight adjusting unit controlling the brightness of the backlight based on the selected brightness information and the image processing gain, wherein the image processing block comprises:

a plurality of image processors each performing image processing on the received image signal using a respective image enhancement algorithm;

an image processing selector selecting one of the image processors based on the measured brightness of the ambient light, and outputting the result of image processing performed by the selected image processor, wherein an image processor of the plurality of image processors using a respective image enhancement algorithm providing a high degree of visibility is selected when the measured brightness of the ambient light is relatively high and wherein an image processor of the plurality of image processors using a respective image enhancement algorithm providing a low degree of image degradation is selected when the measured brightness of the ambient light is relatively low; and an image processing gain calculator calculating the image processing gain based on the received image signal and the result of image processing.

2. The backlight control circuit of claim 1, wherein the backlight brightness selecting block comprises:

an ambient light measuring unit sensing the ambient light and measuring the brightness of the ambient light based on the result of sensing; and a backlight brightness selector selecting the brightness information corresponding to the measured brightness of the ambient light.

3. The backlight control circuit of claim 2, wherein the ambient light measuring unit comprises:

a light sensor sensing the ambient light and outputting a sensed signal based on the result of sensing; and a sampler performing sampling on the sensed signal and outputting the result of sampling.

4. The backlight control circuit of claim 3, wherein the image processing block comprises:

a plurality of image processors each performing image processing on the received image signal using a predetermined image processing algorithm;

an image processing selector selecting one of the image processors based on the result of sampling, and outputting the result of image processing performed by the selected image processor; and an image processing gain calculator calculating the image processing gain of the received image signal based on the received image signal and the result of image processing.

5. The backlight control circuit of claim 1, wherein the image processor is selected from among the plurality of image processors based on the measured brightness of the ambient light.

6. The backlight control circuit of claim 1, wherein the backlight adjusting unit comprises:

a backlight control signal generator outputting a backlight control signal based on the selected brightness information and the image processing gain; and a backlight driver driving the backlight based on the backlight control signal.

7. A display device comprising:

a backlight brightness selecting block measuring the brightness of ambient light, and selecting brightness information of a backlight based on the measured brightness of the ambient light;

an image processing block performing image processing on a received image signal based on the measured brightness of the ambient light, and calculating an image processing gain of the received image signal based on the result of image processing and the received image signal;

a display panel being driven based on the result of image processing;

a backlight adjusting unit controlling the brightness of the backlight based on the selected backlight brightness information and the image processing gain, wherein the image processing block comprises:

a plurality of image processors each performing image processing on the received image signal using a respective image enhancement algorithm;

an image processing selector selecting one of the image processors based on the measured brightness of the ambient light, and outputting the result of image processing performed by the selected image processor, wherein an image processor of the plurality of image processors using a respective image enhancement algorithm providing a high degree of visibility is selected when the measured brightness of the ambient light is relatively high and wherein an image processor of the plurality of image processors using a respective image enhancement algorithm providing a low degree of image degradation is selected when the measured brightness of the ambient light is relatively low; and an image processing gain calculator calculating the image processing gain based on the received image signal and the result of image processing.

8. The display device of claim 7, wherein the backlight brightness selecting block comprises:

an ambient light measuring unit sensing the ambient light and measuring the brightness of the ambient light based on the result of sensing; and a backlight brightness selector selecting the brightness information corresponding to the measured brightness of the ambient light.

9. The display device of claim 8, wherein the ambient light measuring unit comprises:

a light sensor sensing the ambient light and outputting a sensed signal based on the result of sensing; and a sampler performing sampling on the sensed signal and outputting the result of sampling.

10. The display device of claim 9, wherein the image processing block comprises:

a plurality of image processors each performing image processing on the received image signal using a predetermined image processing algorithm;

an image processing selector selecting one of the image processors based on the result of sampling, and outputting the result of image processing performed by the selected image processor; and an image processing gain calculator calculating the image processing gain of the received image signal based on the received image signal and the result of image processing.

11. The display device of claim 7, wherein the image processor is selected from among the plurality of image processors based on the measured brightness of the ambient light.

12. The display device of claim 7, wherein the backlight adjusting unit comprises:

a backlight control signal generator outputting a backlight control signal based on the selected brightness information and the image processing gain; and a backlight driver driving the backlight based on the backlight control signal.

13. A method of controlling the brightness of a backlight in a display device, the method comprising:

selecting brightness of the backlight by measuring the brightness of ambient light, and selecting brightness information of the backlight based on the measured brightness of the ambient light;

selecting one of a plurality of image processors for processing a received image signal based on the measured brightness of the ambient light, wherein each of the plurality of image processors uses a respective image enhancement algorithm, and wherein an image processor of the plurality of image processors using a respective image enhancement algorithm providing a high degree of visibility is selected when the measured brightness of the ambient light is relatively high and wherein an image processor of the plurality of image processors using a respective image enhancement algorithm providing a low degree of image degradation is selected when the measured brightness of the ambient light is relatively low;

image processing a received image signal based on the measured brightness of the ambient light using the selected image processor, and calculating an image processing gain of the received image signal based on the result of image processing and the received image signal; and controlling the brightness of the backlight in the display device based on the selected brightness information and the image processing gain.

14. The method of claim 13, wherein the selecting of the brightness of the backlight comprises:

sensing the ambient light, and measuring the brightness of the ambient light based on the result of sensing; and selecting brightness information corresponding to the measured brightness of the ambient light.

15. The method of claim 14, wherein the calculating of the image processing gain comprises:

outputting an image processing selection signal based on the measured brightness of the ambient light;

selecting one of a plurality of image processing algorithms based on the image processing selection signal, performing image processing on the received image signal using the selected image processing algorithm, and outputting the result of image processing; and calculating the image processing gain of the received image signal based on the received image signal and the result of image processing.

16. The method of claim 13, wherein the controlling of the brightness of the backlight comprises:

outputting a backlight control signal based on the selected backlight brightness information and the image processing gain; and driving the backlight based on the backlight control signal.

* * * * *